United States Patent [19]

Whittenburg et al.

[11] Patent Number: 4,484,063

[45] Date of Patent: Nov. 20, 1984

[54] CONVECTION OVEN

[75] Inventors: Stephen L. Whittenburg, Johnson County, Kans.; James B. Aberer, Danville, Calif.; Albert V. Edmonds; Ching-Wen Yang, both of Jackson County, Mo.; Vernon W. Streck, Cooper County, Mo.; Vernon F. Rodick; Robert C. Enoch, both of Pettis County, Mo.

[73] Assignee: Rival Manufacturing Company, Kansas City, Mo.

[21] Appl. No.: 397,838

[22] Filed: Jul. 13, 1982

Related U.S. Application Data

[63] Continuation of Ser. No. 123,982, Feb. 25, 1980, abandoned.

[51] Int. Cl.[3] ..... A21B 1/26; F24C 15/32

[52] U.S. Cl. ..... 219/400; 126/21 A

[58] Field of Search ..... 126/21 A; 165/119; 219/400, 218; 99/474, 476, 447; 34/219, 224, 232

[56] References Cited

U.S. PATENT DOCUMENTS

| | | | |
|---|---|---|---|
| 1,986,088 | 1/1935 | Wild . | |
| 1,996,680 | 4/1935 | Lobley . | |
| 2,957,067 | 10/1960 | Scofield . | |
| 3,379,189 | 4/1968 | Staples . | |
| 3,514,576 | 5/1970 | Hilton et al. | 219/400 |
| 3,529,582 | 9/1970 | Hurko et al. | 219/400 |
| 3,656,469 | 4/1972 | Jung et al. | 126/21 A |
| 3,780,721 | 12/1973 | Durth | 126/21 A |
| 3,828,760 | 8/1974 | Farber et al. | 126/21 A |
| 4,030,476 | 6/1977 | Hock | 219/218 |
| 4,096,369 | 6/1978 | Tanaka et al. | 126/21 A |
| 4,224,743 | 9/1980 | Erickson et al. | 126/21 A |
| 4,244,979 | 1/1981 | Roderick | 126/21 A |
| 4,332,992 | 6/1982 | Larsen | 219/400 |

FOREIGN PATENT DOCUMENTS

| | | | |
|---|---|---|---|
| 1476119 | 6/1977 | United Kingdom | 219/400 |

*Primary Examiner*—C. L. Albritton
*Assistant Examiner*—Teresa J. Walberg
*Attorney, Agent, or Firm*—Willian, Brinks, Olds, Hofer, Gilson & Lione Ltd.

[57] ABSTRACT

A convection oven being an air distribution chamber above the main cooking compartment is the subject of the present invention. A centrifugal fan draws air from the cooking compartment into the air chamber and directs the air outwardly past an electrical heating element mounted within the air chamber in a serpentine configuration. The heated air passes from the air chamber into the cooking compartment through a series of slots which are arranged in a non-symmetrical pattern in order to heat the cooking compartment uniformly for uniform cooking of the food.

24 Claims, 6 Drawing Figures

CONVECTION OVEN

This application is a continuation of application Ser. No. 06/123,982, filed Feb. 25, 1980, now abandoned.

BACKGROUND AND SUMMARY OF THE INVENTION

This invention relates generally to cooking equipment and deals more particularly with an improved forced air convection oven and a method of cooking food.

The various advantages of forced air convection ovens are well known, as indicated in U.S. Pat. No. 3,529,582 to Hurko et al. Among the most significant benefits of this type of oven is the reduced cooking time and the accompanying decrease in power consumption which results from the forced circulation of air within the oven. This benefit has teken on increased importance in recent years due to the well known problems relating to energy supplies.

Convection ovens such as that shown in the Hurko et al patent employ a fan to pass air across an electrical heating element and then into the oven compartment that contains the food which is to be cooked. In the past, one of the major problems with this type of cooking operation has been to heat the oven compartment in a uniform manner. Existing ovens typically have a simple air distribution pattern which fails to take into account the shape of the heating element, its proximity to the fan, and other factors associated with the geometry of the oven. As a result, the cooking compartment is heated unevenly and the food is not always cooked in a uniform manner. An uneven temperature distribution within the oven also causes the development of "hot spots" which can pose a serious safety problem and which further detract from the effectiveness of the oven. Additional safety problems result from the accessibility of the extremely hot area in the vicinity of the heating element which can inadvertently be contacted by the hands to cause severe burns.

Grease and other undesirable materials are generally circulated throughout the cooking chambers of existing convection ovens. This not only has an adverse effect on the cooking operation but also greatly increases the difficulty involved in cleaning the oven. In particular, the fan and the heating element are exposed to grease and the like which tends to collect in inaccessible areas of the oven which are difficult if not impossible to clean thoroughly. Furthermore, the physical appearance of existing convection ovens suffers from the presence of unsightly hinges and other compartments.

The present invention has as its primary goal the provision of an improved convection oven which overcomes the aforementioned problems.

More specifically, it is an important object of the invention to provide a forced air convection oven and cooking method which achieves substantially uniform heating of the cooking compartment. Particularly significant in this respect are the non-uniform size and non-symmetrical pattern of the discharge openings in the diffuser panel. The discharge openings are arranged to take full advantage of the oven geometry and the configuration of the heating element and its spacing relative to the fan blades and other oven components.

Another important object of the invention is to provide a convection oven having a closed air circulation system. Outside air is not drawn into the oven during operation, and its efficiency is increased accordingly.

Still another object of the invention is to provide a convection oven wherein the heating element and fan are contained in a separate air chamber which is located above the cooking compartment and which is physically isolated therefrom. Consequently, there is no danger of the hottest portion of the oven being contacted inadvertently by the consumer.

An additional object of the invention is to provide a convection oven which prevents grease and the like from circulating throughout the cooking chamber. A removable filter element collects the grease and prevents it from soiling the fan, heating element, and other components of the oven.

A further object of the invention is to provide in a convection oven of the character described, a unique hinge arrangement for the oven door which enhances the appearance of the oven without adversely affecting proper functioning of the door.

Yet another object of the invention is to provide a convection oven of the character described wherein the oven door has a unique double pane construction which affords good insulation and structural strength while permitting observation of the oven contents.

A still further object of the invention is to provide a convection oven of the character described which is simple and economical to manufacture and efficient in operation.

Other and further objects of the invention together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
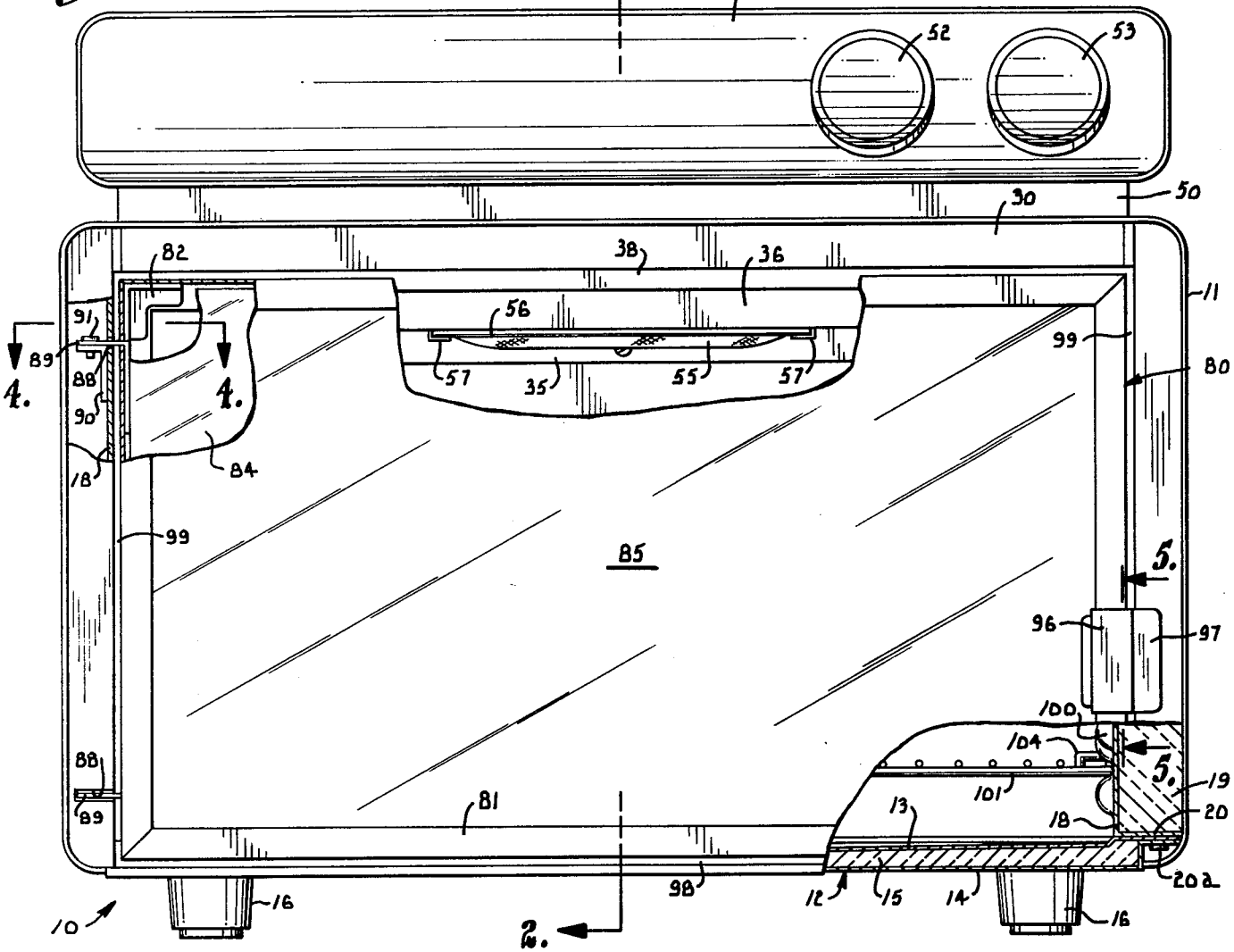
FIG. 1 is a front elevational view of a forced air convection oven constructed according to a preferred embodiment of the present invention, with portions broken away for purposes of illustration.

With initial reference to FIG. 1, numeral 10 generally designates a forced air convection oven constructed in accordance with the present invention. The oven 10 has a box like housing which includes an outer shell 11 extending along both sides and the top portion of the oven. Shell 11 is suitably attached to a floor 12 which includes top and bottom panels 13 and 14 which may contain insulating material 15 therebetween. Padded feet 16 are secured to panel 14 and rest on a counter top or the like.

Figure 2:
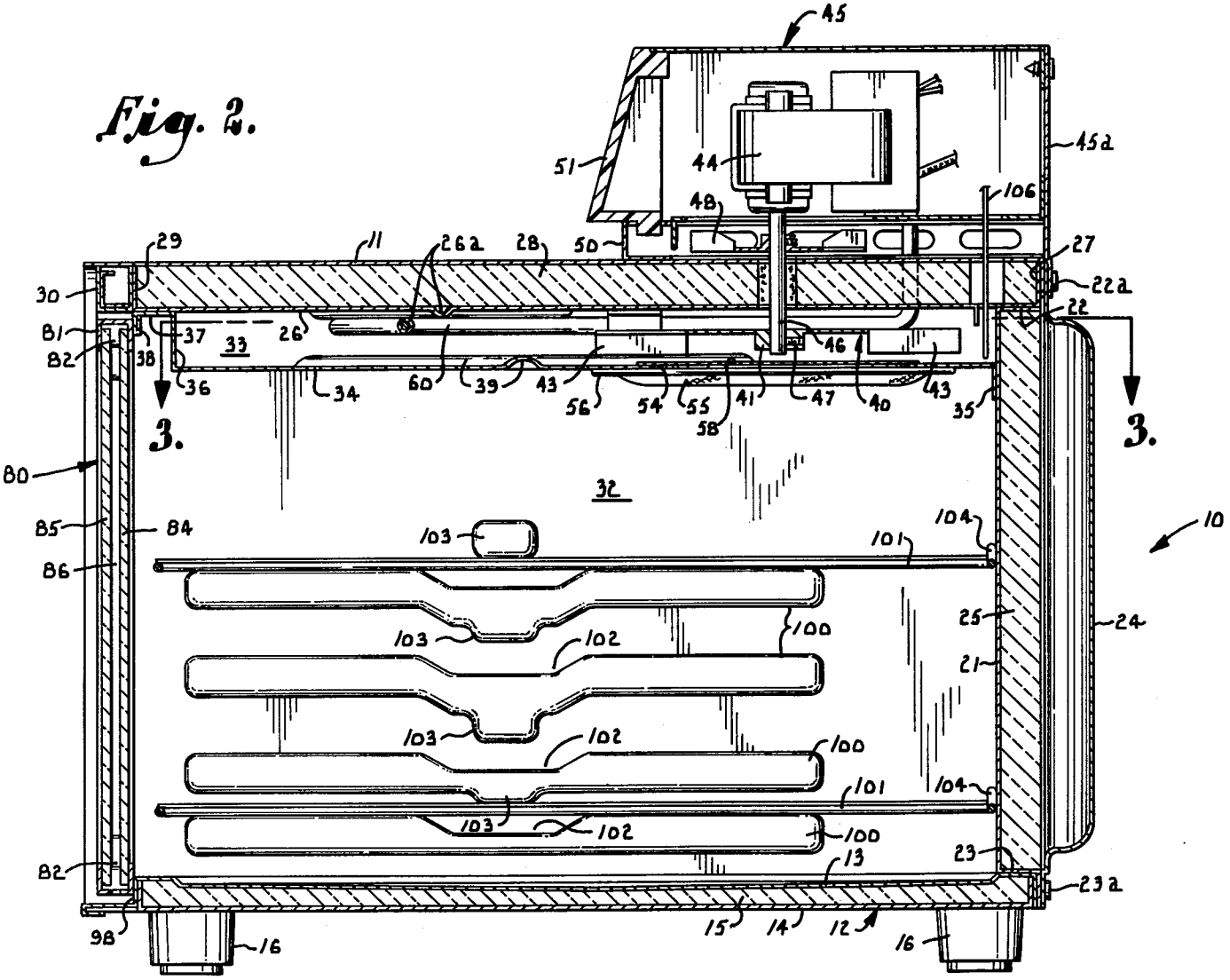
FIG. 2 is a sectional view of the oven taken generally along line 2—2 of FIG. 1 in the direction of the arrows.

Each side wall of the housing includes a sheet metal panel 18 which is spaced inwardly of the corresponding wall of shell 11. Insulating material 19 fills the space between each side panel 18 and the corresponding wall of the shell. Each panel 18 has a horizontal flange 20 on its lower edge which is turned outwardly and secured at 20*a* to the side edge portions of floor panels 13 and 14. As shown in FIG. 2, the back wall of the housing is formed similarly, having a panel member 21 exposed to the interior of the oven. Upper and lower flanges 22 and 23 are secured to the top portion of the housing and to floor 12 by a screw 2*a* extending through housing plate 45, back panel 24 and then connects to flange 26. Similarly, and at the bottom, flange 23 via screw 23*a* secures flange 23 to panel 13. The space between panels 21 and 24 contains suitable insulating material 25.

As previously indicated, the outer shell 11 extends across the top of the housing. As best shown in FIG. 2, a sheet metal panel 26 is spaced below the upper portion of shell 11 and has a flange 27 on its rear edge which is secured to the shell and to panel 24. Insulation 28 fills the area above panel 26 and below the top portion of shell 11. The forward edge of the panel 26 has a flange 29 which is secured to a brace 30 extending across the front of the oven at the upper portion of the housing. Brace 30 is suitably secured to the side walls and flange from panel 26 of the unit and to the shell 11. The underside of panel 26 has a pair of integral ribs 26*a* which intersect with one another in an "X" shaped configuration to stiffen the panel and prevent it from warping (and spaces heating element 60) or otherwise deforming when heated to a high temperature.

The housing walls cooperate to provide a cooking compartment 32 within the housing. Immediately above compartment 32 is an air distribution chamber 33 which is located below panel 26 and above a diffuser panel 34 mounted within the oven. Panel 34 has a downwardly turned flange 35 on its back edge which is suitably secured to panel 21. The front portion of panel 34 is turned upwardly as indicated at 36. A horizontal flange portion 37 is secured to panel 26 near the front of the oven, while a downturned lip 38 is formed on the front edge of panel 34. The upper surface of panel 34 which is exposed to chamber 33 includes a pair of integral ribs 39 which intersect in an "X" shaped configuration and which serve to prevent thermally induced deformation of the diffuser panel.

Figure 3:
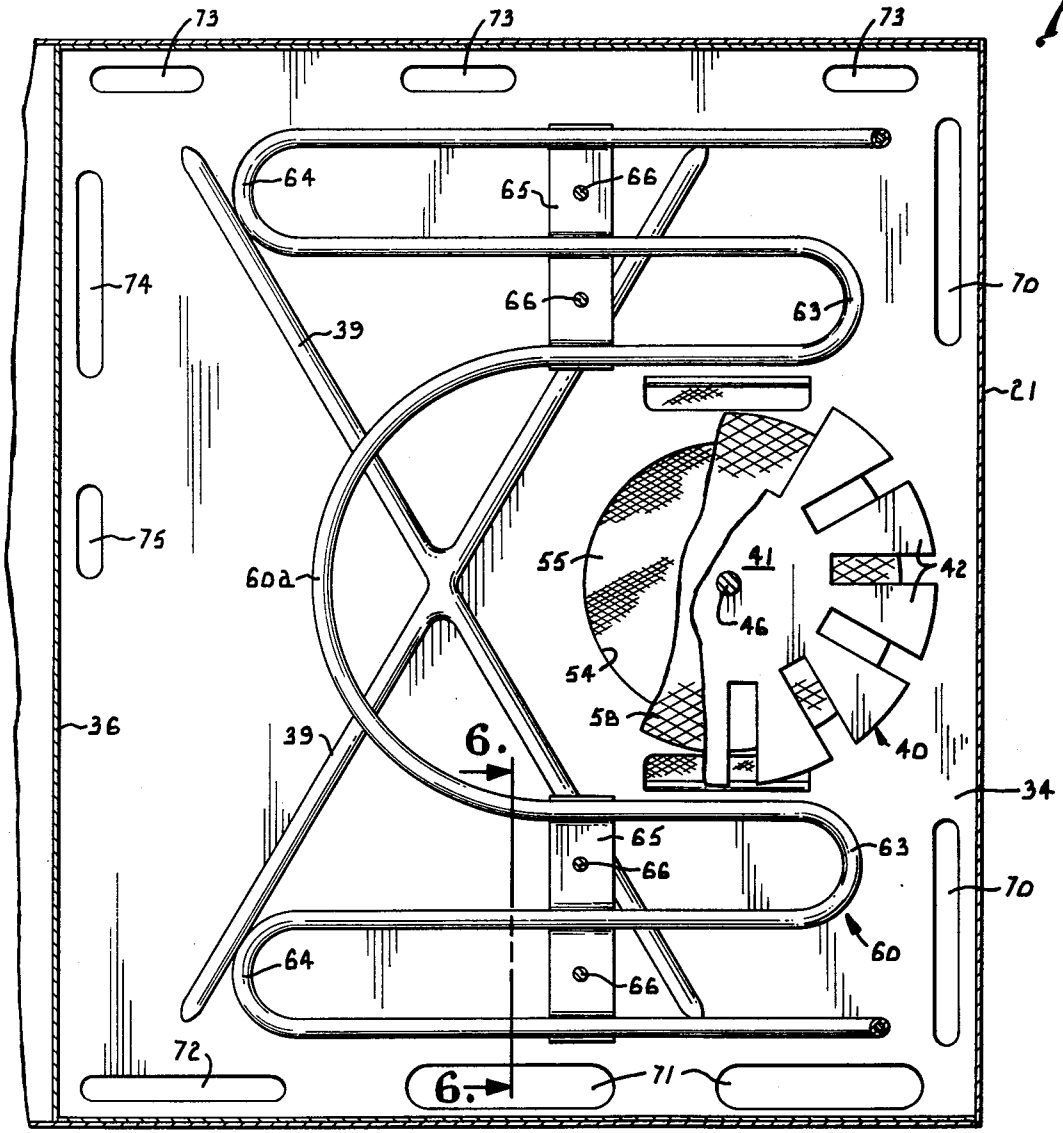
FIG. 3 is a fragmentary sectional view taken generally along line 3—3 of FIG. 2 in the direction of the arrows, with portions broken away for illustrative purposes.

Mounted in air distribution chamber 33 is a centrifugal fan 40 having a central hub portion 41 and a plurality of spaced apart vanes 42 which extend generally radially from the hub portion 41 in a manner best shown in FIG. 3. Each vane 42 carries a vertical fan blade 43 (FIG. 2) which extends downwardly from the trailing edge of the vane.

Fan 40 is driven by a conventional electric motor 44 contained within a motor housing 45 mounted on top of shell 11. Motor 44 drives a vertical shaft 46 to which fan 40 is secured by a set screw 47 threaded into hub portion 41. Shaft 46 carries another fan 48 which is located in the motor housing 45 and which operates to cool motor 44.

Motor housing 45 has a base 50 which is suitably secured to the top portion of shell 11. The front face of housing 45 is formed by a panel 15 having a pair of control knobs 52 and 53 (See FIG. 1). Knob 52 may control the temperature setting of the oven, while the other knob 53 may be a timer which acts to shut off the oven after a preselected time period. These controls are conventional and form no part of the invention.

With particular reference to FIG. 3, diffuser panel 34 has a circular intake opening 54 which is located off-center on the diffuser panel near the back edge thereof. Fan 40 is centered over intake opening 54 in order to draw air from oven compartment 32 into air chamber 33. The central intake side of fan 40 is thus located adjacent opening 54, while the vanes 42 and fan blades 43 act to discharge the air generally radially outwardly from the periphery of the fan.

A conventional filter element 55 is mounted immediately below opening 54 to the underside of panel 34. The filter element is preferably constructed of aluminum mesh fibers which are able to extract grease and other undesirable materials from the air which passes through the filter element. As best shown in FIG. 1, filter 55 has a peripheral bead 56 which is supported on a pair of slide members or flanges 57 extending from the underside of diffuser panel 34. Filter element 55 is thus located directly below intake opening 54 such that any air passing through the intake opening is filtered. Element 55 may be removed for cleaning by simply sliding it forwardly until bead 56 clears the flange 57.

A circular screen 58 is mounted on top of diffuser panel 34 in a position to cover intake opening 54. Screen 58 is located below fan 40 and above filter 55 and serves to prevent fan 40 from being inadvertently contacted when the filter is removed.

Figure 6:
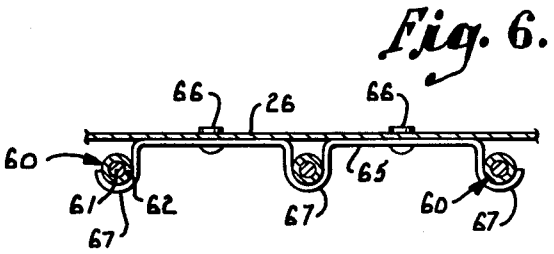
FIG. 6 is a fragmentary sectional view taken generally along line 6—6 of FIG. 3 in the direction of the arrows.

Fan 40 circulates the air past an electrically resistive heating element 60 which is mounted in chamber 33. Heating element 60 is an elongate member having a heater wire 61 encased within a sheath 62, as best shown in FIG. 6. The heating element is arranged in a serpentine configuration which includes a pair of loops 63 and 64 on each side of fan 40 (See FIG. 3.). It is pointed out that the heating element is arranged in a non-symmetrical manner with respect to intake opening 54 and fan 40. Referring again to FIG. 6, heating element 60 is mounted to panel 26 by a pair of brackets 65. Each bracket 65 is secured to panel 26 by a pair of rivets 66, and each bracket includes three spaced apart grooves 67 which receive the straight portions of heating element 60 located between the loops 63 and 64. In this fashion, heating element 60 is mounted in substantially the same horizontal plane which contains the upper surface of fan 40. The opposite sides of heating element 60 are connected by an arcuate portion 60*a* (FIG. 3).

FIG. 3 illustrates a plurality of elongated slots which are formed in diffuser panel 34 to provide discharge outlets directing heated air from chamber 33 back into cooking compartment 32. All of the discharge openings are located outwardly of intake opening 54 and the heating element 60, being arranged generally along the peripheral edges of panel 34. The openings vary from one another in their size and shape and are arranged in a non-symmetrical pattern on the diffuser panel 34 in order to effect uniform heating of compartment 32.

Numeral 70 designates a pair of the discharge openings or slots which are formed near the back edge of panel 34. Another pair of openings 71 are located along the edge of panel 34 which represents the right edge when viewed from the front. Openings 71 are shorter than openings 70 and considerably wider. A third opening 72 is formed along the right edge of the diffuser panel near the forward end thereof. Opening 72 has substantially the same width as openings 70 but is slightly shorter.

The left hand edge portion of panel 33 includes three relatively small discharge openings 73 which are considerably shorter than openings 70–72. As illustrated, openings 73 are spaced apart in a non-uniform manner. Numeral 74 designates an elongate slot which is formed along the front edge of panel 34 near the forward most opening 73. Slot 74 is substantially the same size and configuration as slot 72. A much smaller opening 75 is formed generally centrally along the forward edge of the diffuser panel. Opening 75 has substantially the same size and shape as the openings 73 located along the left edge of the diffuser panel. The diffuser panel does not present a discharge opening in the area between slots 72 and 75. The discharge openings 70–75 are all in the form of slots which are longer than they are wide.

Figure 4:
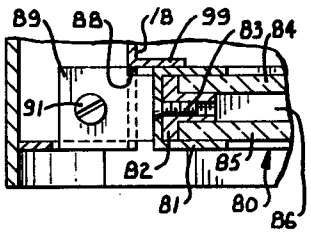
FIG. 4 is a fragmentary sectional view on an enlarged scale taken generally along line 4—4 of FIG. 1 in the direction of the arrows.

An oven door 80 is mounted to the front of the housing in order to open and close the front opening which provides access to oven compartment 32. As best shown in FIG. 4, door 80 has a border or rim in the form of a "U" shaped channel 81 which extends along both sides of the door and the top and bottom edges thereof. Mounted within channel 81 at each corner thereof is a spacer 82 having a "T" shaped cross section. Each spacer 82 is held in place be a screw 83 which secures it to channel 81. A pair of high temperature glass panes 84 and 85 forming part of the oven door are held in spaced apart relation by the spacers 82. The edges of panes 84 and 85 are held between the central portions of spacers 82 and the corresponding inner or outer leg of the "U" shaped channel 81. Panes 84 and 85 are thus spaced apart from one another to provide a gap 86 therebetween for thermally insulating the door. One of the glass panes is preferably clear glass, while the other is tinted. Consequently, the door exhibits the advantages of tinted glass while permitting the contents of the oven to be easily observed.

As shown in FIGS. 1 and 4, the left panel 18 has a pair of small slots 88 which receive flat hinges 89 extending from the left edge of door 80. A pair of hinge brackets 90 are mounted adjacent slots 88 to the surface of panel 18 which faces to the inside of the oven wall. Each hinge 89 is pivotally connected with the corresponding hinge bracket 90 by a coupling element such as a screw 91. Door 80 is thus mounted to the oven housing for pivotal opening and closing movement about the vertical hinge axis provided by pivot couplings 91. It is pointed out that the entirety of each bracket 90 and the majority of each hinge 89 is located within the side wall of the oven. Accordingly, the small slots 88 provide the only visible evidence of a hinge mechanism, and the physical appearance of the oven is thereby enhanced.

Figure 5:
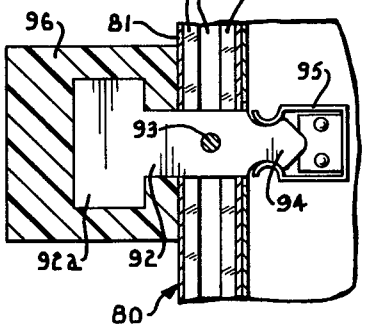
FIG. 5 is a fragmentary sectional view on an enlarged scale taken generally along line 5—5 of FIG. 1 in the direction of the arrows.

Door 80 is held in the closed position by a bayonet type latch which is best illustrated in FIG. 5. The latch includes a male latch member 92 which extends through door 80 near the lower right hand corner thereof. Latch member 92 is secured to the door by two pop rivets 93 and has a reduced head portion 94 projecting inwardly from the door. The head portion 94 is received by a female latch element 95 which engages latch member 92 in a manner to releasably hold the door 80 in the closed position covering the front of the oven. The female latch element 95 is mounted to the right side wall of the oven housing. A plastic knob 96 is mounted on the outer end of latch member 92 by means of a key way in the knob which receives an enlarged key portion **92*a* of the male latch member. Latch member 92 thus serves both as the male portion of the latch mechanism and as a means for mounting knob 96. The knob has a flange 97 (FIG. 1**) which prevents the fingers of the user from possibly contacting a hot surface.

When door 80 is closed as shown in FIG. 2, it is in firm contact with the lip 38 formed on the front edge of diffuser panel 34. The lower edge of the door contacts a similar lip portion 98 of floor panel 13. Side panels 18 have similar lips 99 (FIG. 4) which contact the door. These lips prevent the hot air within the oven compartment 32 from leaking to any appreciable extent.

As best shown in FIG. 2, each side panel 18 has on its inside surface a plurality of rack supports 100 for supporting wire racks 101 which are adapted to receive the food which is to be cooked within the oven. Each rack support 100 has near its center a recessed portion 102. Spaced above each recess 102 is a stop 103 formed on the next higher rack support at a location above the top surface of the rack support having the recess. The uppermost stop 103 is simply formed on panel 18. The back edge of each rack 101 has an up turned wire 104 which contacts stop 103 if an attempt is made to pull the rack straight out the front of the oven. Consequently, each rack 101 must have its front end tilted upwardly in order to permit wire 104 to pass stop 103. The wire racks thus cannot be inadvertently pulled completely out of the oven but must be removed intentionally by tilting them as they are pulled forwardly.

In operation of the oven, the food which is to be cooked is placed within cooking compartment 32 on one of the wire racks 101. The temperature at which the food is to be cooked is set on one of the knobs on panel 51, which the cooking time is set on the other knob. The oven is preferably equipped with a conventional thermostat which includes a vertical capillary tube 106 shown in FIG. 2. When the temperature sensed by the thermostat is above the temperature setting of the oven, heating element 60 is de-energized, and they are also de-energized after elapse of the time which is set on the timer knob of the oven.

Cooking of the food is accomplished by the combined action of fan 40 and heating element 60. The fan draws air from oven compartment 32 into air chamber 33 through the intake opening 54 in diffuser plate 34. The air is then directed outwardly from the periphery of fan 40 in a generally radial direction. The air is thus directed in proximity to the heating element 60 which heats the air prior to its discharge back into compartment 32 through the discharge openings 70–75. The heated air which is thereby directed into compartment 32 cooks the food which is contained therein.

It has been found experimentally that the nonsymmetrical arrangement of discharge outlets 73–75 and the varying sizes and shapes thereof results in a substantially even temperature distribution within the oven compartment 32. It is thought that the effectiveness of the cooking discharge openings in achieving uniform heating of the cooking chamber is due primarily to their relationship with the heating element and the off-center intake opening 54, in cooperation with the air circulation pattern within chamber 33. It is noted that the larger holes are for the most part located where less heat is generated, and the smaller holes are located where the air is hottest. The air turbulence and circulation pattern which results from the geometry of the oven, and the size and arrangement of the discharge openings, causes the heat which enters compartment 32 to be distributed uniformly throughout the cooking compartment.

The diffuser panel 34 provides a partition between chambers 32 and 33 and thus prevents the user from inadvertently contacting the hottest portion of the oven in the area of the heating element. At the same time, the diffuser panel 34 distributes the heated air in the proper manner to the cooking compartment in order to uniformly cook the food therein. Any grease or other undesirable material present in compartment 32 is filtered out of the circulating air by filter element 55. The filter can be easily removed and periodically cleaned.

It is thus evident that the present invention provides an improved forced air convection oven which achieves uniform heating of the cooking compartment and consequent uniform cooking of the food contained therein. The effectiveness of the cooking operation does not decrease with increasing quantities of food in the cooking chamber. In addition, the forced air circulation system cooks the food more quickly than is accomplished in conventional ovens. Fan 40 does not draw in air from outside the oven but instead circulates preheated air from within compartment 32 in order to enhance the efficiency of the oven in comparison to units which utilize outside air.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A forced air convection oven comprising:

a housing presenting a cooking compartment therein adapted to receive food to be cooked, said cooking compartment having an opening providing access thereto for inserting and removing food;

a door mounted to said housing for opening and closing movement to open and close said opening of the cooking compartment;

means presenting a substantially enclosed air chamber located above said cooking compartment;

a diffuser panel positioned above the cooking compartment between the cooking compartment and the air chamber to provide a partition between said air chamber and cooking compartment, said diffuser panel having an intake opening in communicating relationship with said cooking compartment and a a plurality of spaced apart discharge openings therein providing communication between said air chamber and cooking compartment for circulation of air therebetween;

a heating element mounted in said air chamber;

a fan mounted in said air chamber with an intake side of the fan in communicating relationship with said intake opening to draw air from the cooking compartment into said air chamber, said fan having a discharge side in the air chamber oriented and arranged to direct air in proximity to the heating element for heating of the air and subsequent circulation of the heated air through said discharge openings into the cooking compartment to heat the food therein; and power means for driving said fan;

said discharge openings of the diffuser panel being arranged in a nonsymmetrical configuration to create a nonsymmetrical flow pattern of discharged heated air into the cooking compartment, said nonsymmetrical flow pattern effective to provide substantially uniform heating of the cooking compartment.

2. An oven as set forth in claim 1, including a filter element substantially covering said intake opening of the diffuser panel, said filter element being air permeable and being adapted to remove grease from the air passing through the filter element into said air chamber.

3. An oven as set forth in claim 2, including a screen element mounted between said filter element and the intake side of said fan to substantially cover the bottom of the fan.

4. An oven as set forth in claim 1, including:

an air permeable filter element adapted to remove grease from air passing therethrough; and means for removably mounting said filter element to said diffuser panel at a position to substantially cover said intake opening.

5. An oven as set forth in claim 4, including a screen mounted in said air chamber and substantially covering said air intake opening at a location between the filter element and fan.

6. An oven as set forth in claim 1, including:

a side wall of said housing having an interior region substantially filled with insulating material, said side wall having a slot therein on a surface located adjacent said door;

a hinge bracket supported by said side wall within said interior region thereof at a location adjacent said slot;

a hinge extending from said door through said slot into said interior region of the side wall; and means pivotally coupling said hinge with said hinge bracket to mount said door for pivotal opening and closing movement.

7. An oven as set forth in claim 1, including:

a first latch member mounted to said door and projecting therefrom;

a second latch member mounted on said housing for receiving said first latch member in a manner to releasably maintain the door in a closed position covering the opening of said cooking compartment; and a knob mounted on said first latch member at a location accessible from the exterior of said cooking compartment.

8. An oven as set forth in claim 1, including a plurality of ribs formed integrally on said diffuser panel to resist thermally induced deformation of said panel.

9. An oven as set forth in claim 1, including:

a top panel mounted to said housing and overlying said air chamber; and bracket means mounted to said top panel and supporting said heating element thereon.

10. An oven as set forth in claim 1, wherein each discharge opening is in the form of an elongated slot having a length dimension greater than a width dimension thereof.

11. An oven as set forth in claim 10, wherein each slot has length and width dimensions which are different from the length and width dimensions of other slots.

12. An oven as set forth in claim 10, wherein said diffuser panel has a peripheral portion and said slots are arranged generally along said peripheral portion in spaced apart relation.

13. An oven as set forth in claim 12, wherein the spacing between said slots is non-uniform.

14. An oven as set forth in claim 13, wherein said slots vary from one another in their length and width dimensions.

15. A forced air convection oven comprising:

a housing presenting a cooking chamber therein adapted to receive food to be cooked;

an air chamber defined above said cooking compartment;

a diffuser panel mounted to said housing above the cooking chamber to form a partition separating said air chamber from said cooking compartment, said diffuser panel presenting an intake opening therein providing a flow path for air to enter said air chamber from said cooking compartment;

a heating element mounted in said air chamber above said diffuser panel, said heating element having a configuration presenting looped portions of the heating element on opposite sides of said intake opening;

a centrifugal fan mounted in said air chamber for rotation, said fan having a substantially centrally located intake side communicating with said intake opening and a plurality of vanes operable to direct air generally outwardly toward said heating element in response to rotation of the fan, thereby passing air in proximity to said heating element and the looped portions thereof for heating of the air in said air chamber;

power means for effecting rotation of said fan; and a plurality of discharge openings in said diffuser panel providing flow paths for the heated air to pass from said air chamber into said cooking compartment for cooking of the food therein, said discharge openings being arranged about said intake opening and outwardly of and laterally spaced from said heating element in a nonsymmetrical pattern such that air is moved by the fan generally radially outwardly past the heating element through the discharge openings, directly into the cooking chamber thereby creating a non-symmetrical flow pattern of discharged heated air into the cooking compartment, which non-symmetrical flow pattern provides even heating of the cooking chamber.

16. An oven as set forth in claim 15, wherein each discharge opening has a different size than the other of the discharge openings.

17. An oven as set forth in claim 15, wherein each discharge opening is in the form of an elongate slot having a length dimension greater than a width dimension thereof.

18. An oven as set forth in claim 17, wherein said slots are spaced apart from one another in a nonuniform manner.

19. An oven as set forth in claim 18, wherein each slot has length and width dimensions different from the length and width dimensions of other slots.

20. An oven as set forth in claim 15, wherein said vanes and heating element are located in substantially the same plane.

21. A method of cooking food comprising the steps of:

inserting the food in a substantially enclosed cooking compartment;

drawing air from said cooking compartment into an air chamber located adjacent thereto;

arranging a heating element in a nonsymmetrical configuration about the point of entry of air into said air chamber;

energizing said heating element to emit heat therefrom;

directing air generally outwardly in all directions from said point of entry past said heating element to effect heating of the air; and discharging the heated air from said air chamber into said cooking compartment through openings asymmetrically placed radially outwardly from said heating element with respect to said point of entry in order to create a nonsymmetrical pattern of discharged heated air which effects substantially uniform heating of the cooking compartment.

22. An oven as set forth in claim 1 wherein the fan directs air radially outwardly from the discharge side, wherein the heating element is asymmetrically positioned at least partially around the discharge side, and wherein said discharge openings are positioned radially outwardly from the heating element with respect to the discharge side.

23. The invention of claim 22 wherein the fan directs air radially outwardly in all directions from the discharge side, and wherein the discharge openings are laterally spaced from the heating element around a peripheral portion of the diffuser panel.

24. The invention of claim 23 wherein the heating element is entirely disposed radially inwardly from the peripheral portion of the diffuser panel.

* * * * *